US008733672B2

(12) United States Patent
Nations

(10) Patent No.: US 8,733,672 B2
(45) Date of Patent: May 27, 2014

(54) ROTARY IRRIGATION SPRINKLER WITH AN ELECTROMAGNETIC DRIVE SYSTEM

(75) Inventor: Derek Michael Nations, Tucson, AZ (US)

(73) Assignee: Rain Bird Corporation, Azusa, CA (US)

( * ) Notice: Subject to any disclaimer, the term of this patent is extended or adjusted under 35 U.S.C. 154(b) by 196 days.

(21) Appl. No.: 13/297,069

(22) Filed: Nov. 15, 2011

(65) Prior Publication Data

US 2012/0126028 A1 May 24, 2012

Related U.S. Application Data

(60) Provisional application No. 61/417,054, filed on Nov. 24, 2010.

(51) Int. Cl.
*B05B 3/04* (2006.01)

(52) U.S. Cl.
USPC ..... 239/240; 239/241; 239/237; 239/263.1; 239/263.2; 239/263.3

(58) Field of Classification Search
USPC ..... 239/225.1, 237, 240, 263.1–263.3, 241; 310/83; 290/54
See application file for complete search history.

(56) References Cited

U.S. PATENT DOCUMENTS

| | | | | |
|---|---|---|---|---|
| 2,592,609 | A | 4/1952 | Shoemaker | |
| 3,915,383 | A | 10/1975 | King | |
| 3,921,912 | A | 11/1975 | Hayes | |
| 4,379,976 | A * | 4/1983 | Pitchford et al. | 310/83 |
| 5,092,523 | A | 3/1992 | Rucker et al. | |
| 5,236,126 | A | 8/1993 | Sawade et al. | |
| 5,597,119 | A * | 1/1997 | Gorney et al. | 239/241 |
| 6,336,596 | B1 | 1/2002 | Katzman et al. | |
| 6,766,967 | B2 | 7/2004 | Harris et al. | |
| 6,864,591 | B2 | 3/2005 | DeFrank | |
| 6,885,114 | B2 * | 4/2005 | Baarman et al. | 290/43 |
| 6,972,558 | B1 * | 12/2005 | Robinson | 324/207.22 |
| 7,111,796 | B2 * | 9/2006 | Olson | 239/452 |
| 7,287,710 | B1 | 10/2007 | Nelson et al. | |
| 2008/0272205 | A1 * | 11/2008 | Jorgensen et al. | 239/240 |

* cited by examiner

*Primary Examiner* — Jason Boeckmann
*Assistant Examiner* — Joel Zhou
(74) *Attorney, Agent, or Firm* — Fitch, Even, Tabin & Flannery, LLP

(57) ABSTRACT

A magnetically driven irrigation sprinkler is disclosed with a magnetic drive mechanism for rotating a fluid outlet relative to a fluid inlet. In one form, the drive mechanism includes a permanently polarized magnet and an electromagnet.

19 Claims, 7 Drawing Sheets

ROTARY IRRIGATION SPRINKLER WITH AN ELECTROMAGNETIC DRIVE SYSTEM

CROSS-REFERENCE TO RELATED APPLICATION

This application claims benefit of U.S. Provisional Application No. 61/417,054, filed Nov. 24, 2010, which is hereby incorporated herein by reference in its entirety.

FIELD

The field relates to irrigation sprinklers and, more particularly, to rotary-type irrigation sprinklers with magnetic drive mechanisms.

BACKGROUND

A rotary-type irrigation sprinkler commonly includes a rotatable turret mounted at an upper end of a lower stationary body or other fixed assembly. The turret includes one or more nozzles for distributing water and is commonly rotated through an adjustable arcuate water distribution pattern to provide irrigation over a ground surface area. Rotary sprinklers generally include a drive system, which may include a water-driven motor, to transfer energy of the incoming water into a source of power to rotate the turret. One common mechanism for the motor employs a water-driven turbine and a gear train or gear reduction system to convert a high-speed rotation of the water-driven turbine into relatively low-speed turret rotation. During normal operation, the flow of incoming water into the sprinkler rotates the turbine at a relatively high rotational speed due to the velocity and pressure of the water stream. Then, the gear reduction system converts the relatively high rotational speed of the turbine to a lower rotational speed used to rotate the turret. The gear reduction system commonly includes a number of selected interconnecting gears configured to step down the rotational speed through various gearing ratios. The turret then rotates to distribute water outwardly from the sprinkler nozzles over surrounding terrain in an arcuate pattern.

The most convenient placement for these water-driven motors is usually in the lower stationary portion of the sprinkler assembly, which is upstream of the turret and nozzle. The stationary portion of the sprinkler generally provides the most space to receive the motor and other components of the drive assembly, as the inside of this stationary portion is large enough to hold both the turbine and other gear-reduction components. In this position, however, the entire drive motor and gear train system is located within the water flow path and, therefore, potentially exposed to any dirt or debris in the water, which may work its way into the individual gearing components. Dirt lodged in the gear train and reduction system can damage and limit the useful life of the gearing mechanisms.

If the turbine or gearing becomes damaged, due to the location of the water-driven motor in the stationary body and upstream of the turret, these units are generally not easily accessed in an installed sprinkler system to perform field repairs. Typically, if a gear train becomes damaged, the entire sprinkler assembly including both the turret and stationary body may need to be replaced because the motor generally cannot be accessed in the sprinkler body as a result of the turret components hindering access.

Electrically-driven motors have also been tried in irrigation sprinklers, but the use of electric motors for sprinklers presents challenges and has several shortcomings. For one, providing an electric motor inside the sprinkler housing within the flow of water poses a risk of water entering the motor, which can result in a short and damage to the motor. Typically, shaft seals or other water tight membranes are required to isolate the motor from the water source. Such seals, however, can fail over time resulting in undesired water leakage into the motor. Moreover, supplying sufficient current to run an electrical motor large enough to rotate an irrigation sprinkler turret often requires an external source of electricity to provide the needed current. In this case, there is the disadvantage of routing electrical wires from the external power source, such as an electrical connection to a home or other building, out to the individual sprinkler heads. With the size and complexity of common irrigation systems, routing electrical wiring to each irrigation head adds undesired complexity to the irrigation system.

DETAILED DESCRIPTION OF THE PREFERRED EMBODIMENTS

Disclosed are rotary sprinklers having an electromagnetic drive system to rotate a fluid outlet relative to a fluid inlet. In one aspect, the electromagnetic drive system includes a power generator and a drive unit or drive mechanism operable to rotate the fluid outlet of an irrigation sprinkler. By one approach, the power generator may provide an electric charge or current to the drive unit in order to energize an electromagnet so that a magnetic force is used to drive rotation of the sprinkler's fluid outlet. In another aspect, the drive unit may use a combination of permanent magnets, electromagnets, and associated magnetic forces therebetween to drive rotation of the sprinkler outlet. In yet another aspect, the drive unit may rotate the sprinkler outlet through electric pulses to the electromagnet to intermittently polarize the electromagnet where the electric pulses are generated internally to the sprinkler through an internal power generator.

By utilizing the electromagnetic drive systems described herein, an electrical based drive system for an irrigation system can be provided with an internal source of electrical power without the need for external power or the corresponding wiring to supply such external power to a sprinkler located remote from the power source. Moreover, the electromagnetic drive systems herein avoid the need for large electric motors and the complex shaft seals required if an electric motor is employed internally to a sprinkler housing.

Figure 1:
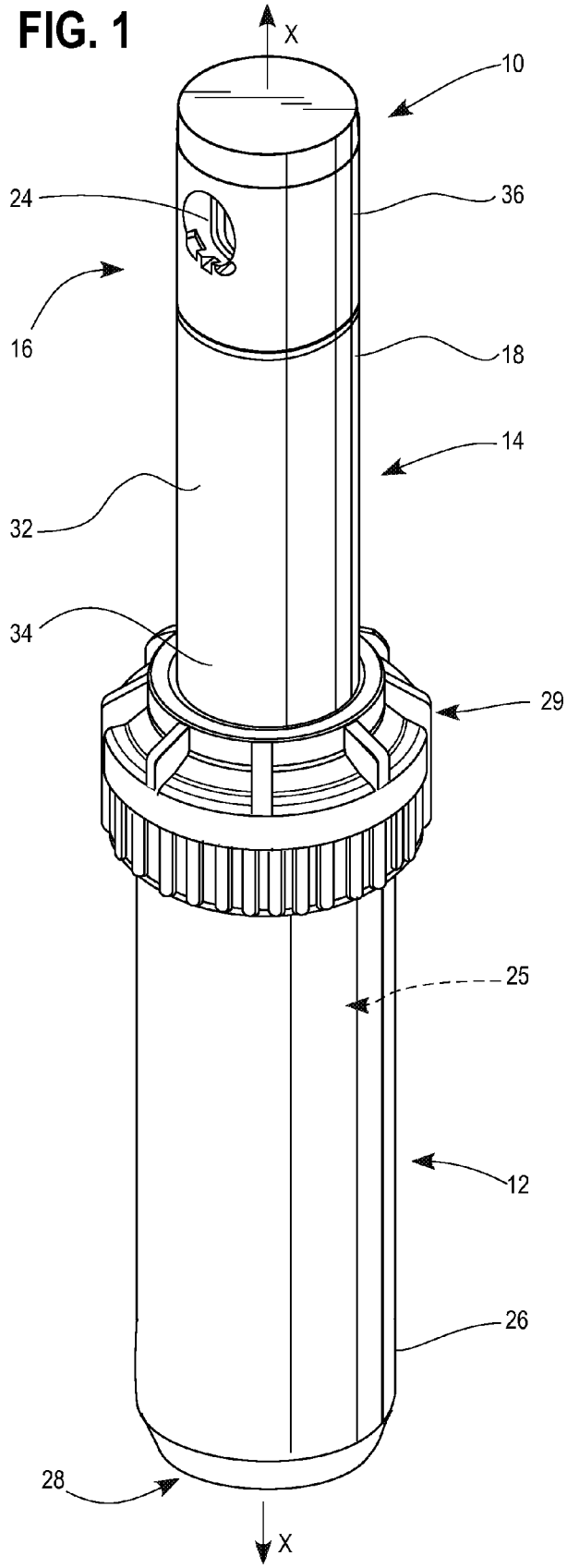
FIG. 1 is a perspective view of an exemplary rotary sprinkler.

By one approach, the electromagnetic drive systems provided herein are suitable for a rotary pop-up sprinkler, but also may be used on other rotating-type sprinklers. For convenience, the drive systems will be described with an exemplary pop-up type rotary sprinkler. As shown in FIG. 1, for example, a suitable rotary pop-up sprinkler 10 is illustrated that includes a stationary sprinkler housing 12 for being received in the ground. The housing 12 has a longitudinal axis X extending between opposite ends thereof and a pop-up riser assembly or riser tube 14 coupled with the housing 12 and configured to shift axially along the housing axis X. The riser assembly 14 includes a rotatable nozzle turret 16 on an upper end 18 of the riser assembly 14.

In general, the sprinkler housing 12 provides a protective covering for the riser assembly 14 and serves as a conduit for directing incoming water under pressure to the riser 14. The housing 12 preferably has the general shape of a cylindrical tube and may be made of a sturdy lightweight injection molded plastic or similar material. The housing 12 has a lower end 26 with a fluid inlet 28 for the sprinkler that may be coupled to a water supply pipe or other source of fluid. At the opposite end, the housing 12 may also include an upper cap 29 having an aperture therein in which the riser assembly 14 slideably extends through.

The riser assembly 14 is in fluid communication with fluid received by the fluid inlet 28 and is configured to generally travel along the axis X between a spring-retracted position, where the riser 14 is retracted into the housing 12, and an elevated spraying position, where the riser 14 is elevated out of the housing 12, as generally shown in FIG. 1. The riser assembly 14 includes the rotatable nozzle turret 16 and a lower, non-rotatable or stationary body portion 32. The turret 16 has at least one opening or fluid outlet 24 in an outer wall thereof for receipt of a nozzle, a flow passage, or a channel therein for distributing water over an adjacent ground surface area. One exemplary shape of the outlet 24 is illustrated in FIG. 1. Others shapes, nozzles, and outlets may also be used as needed for a particular application. When the supply water is on, the riser assembly 14 extends out of the housing 12 and above ground level so that water can be distributed from the nozzle over the ground surface area for irrigation. When the water is shut off at the end of a watering cycle, the riser assembly 14 retracts into the housing 12 where it is protected from damage. As is appreciated from the above, the sprinkler 10 generally includes the fluid inlet 28, the fluid outlet 24 in the turret 16 that rotates relative to the fluid inlet 28, and a fluid flow path 25 that extends generally therebetween through the housing 12 and the riser tube 14.

The riser assembly 14 may include the lower, non-rotatable or stationary body 32 generally in the form of a non-rotatable riser stem with a lower end 34 and the upper end 18. The rotatable turret 16 is rotatably mounted on the upper end 18 of the non-rotatable riser stem 32. Preferably, the rotatable turret 16 includes a housing 36 forming the main structure of the turret 16 that rotates relative to the stem 32 upper end 18 to water a predetermined pattern, which may be adjustable from part-circle, reversing rotation between 0° to 360° arcuate sweeps or a full-circle, non-reversing rotation. The non-rotatable riser stem 32 may be an elongated hollow tube, which is preferably made of a lightweight molded plastic or similar material. As described in more detail below, the electromagnetic drive systems provided herein are preferably located internally to the riser stem 32 of the turret 16, but may be completely or partially located in other portions of the sprinkler 10, such as in the housing 12, the turret 16, or other portions thereof.

Figure 2:
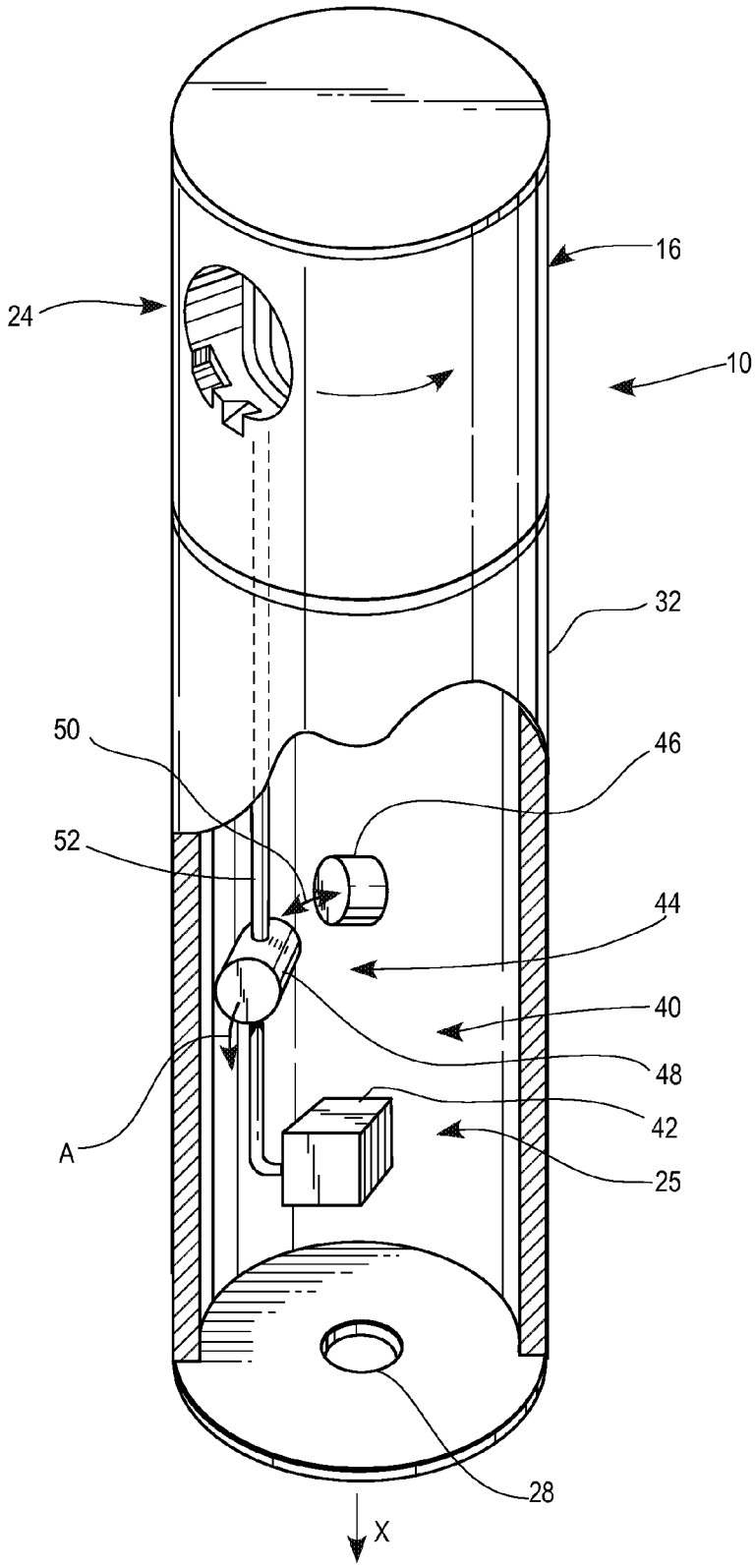
FIG. 2 is a partially cutaway perspective view of a riser of the exemplary rotary sprinkler.

Turning to FIG. 2, one form of an electromagnetic drive system 40 is generically illustrated. The electromagnetic drive system 40 generally includes an internal power generator 42 and an internal drive unit or drive mechanism 44. The power generator 42 is operably coupled to the drive unit 44 and both are configured to effect rotation of the nozzle turret 16. By one approach, the power generator 42 is located completely internally to the riser stem 32 and may be an electrical generator positioned in a manner so that it can generate electricity by interacting with a pressurized fluid flowing through the fluid flow path 25 from the inlet 28 to the outlet 24.

The drive unit 44 may be a pair of drive magnets 46, 48 that interact with each other to rotate the nozzle turret 16. By one approach, at least one of the magnets 46 and/or 48 is coupled or linked to the nozzle turret 16 in a manner to rotate the fluid outlet 24 relative to the fluid inlet 28 as the magnets 46, 48 interact with each other. By another approach, one of the drive magnets 46 is a permanently polarized magnet, and the other drive magnets 48 is an electromagnet that can be magnetically polarized when exposed to an electric current generated by the electrical generator 42. When the electromagnet is magnetically polarized, a magnetic coupling 50 is formed between the permanently polarized magnet 46 and the electrically polarized magnet 48 that functions to shift or urge the magnet 48 circumferentially about the housing axis X to drive rotation of the turret 16 and outlet 24. Alternatively, the electromagnet and permanent magnet may be switched so that the magnet 46 is an electromagnet and the other magnet 48 is a permanent magnet, or both magnets 46 and 48 may be electromagnets.

By one approach, the electromagnet 48 is preferably coupled or linked 52 to the fluid outlet 24 and/or the turret 16. As a result, movement of the magnet 48 is operable to rotate the fluid outlet 24 about the housing axis X or, in other words, rotate the fluid outlet 24 relative to the stationary fluid inlet 28. In one approach, the permanent magnet 46 and the electrically polarized magnet 48 are oriented in the same operational plane, which is situated generally transverse to the housing axis X. So arranged, the magnets 46, 48 can be placed so that the same magnetic poles thereof are positioned adjacent each other so that in use the magnetic coupling 50 is a magnetic repulsion force. Preferably, the magnetic repulsion force 50 is strong enough to urge or shift the electrically polarized magnet 48 away from permanent magnet 46 in the direction of Arrow A within the operational plane to effect the rotation of the turret 16. As will be described in more detail below, such arrangement of magnets is one approach to rotate the nozzle turret 16.

Figure 3:
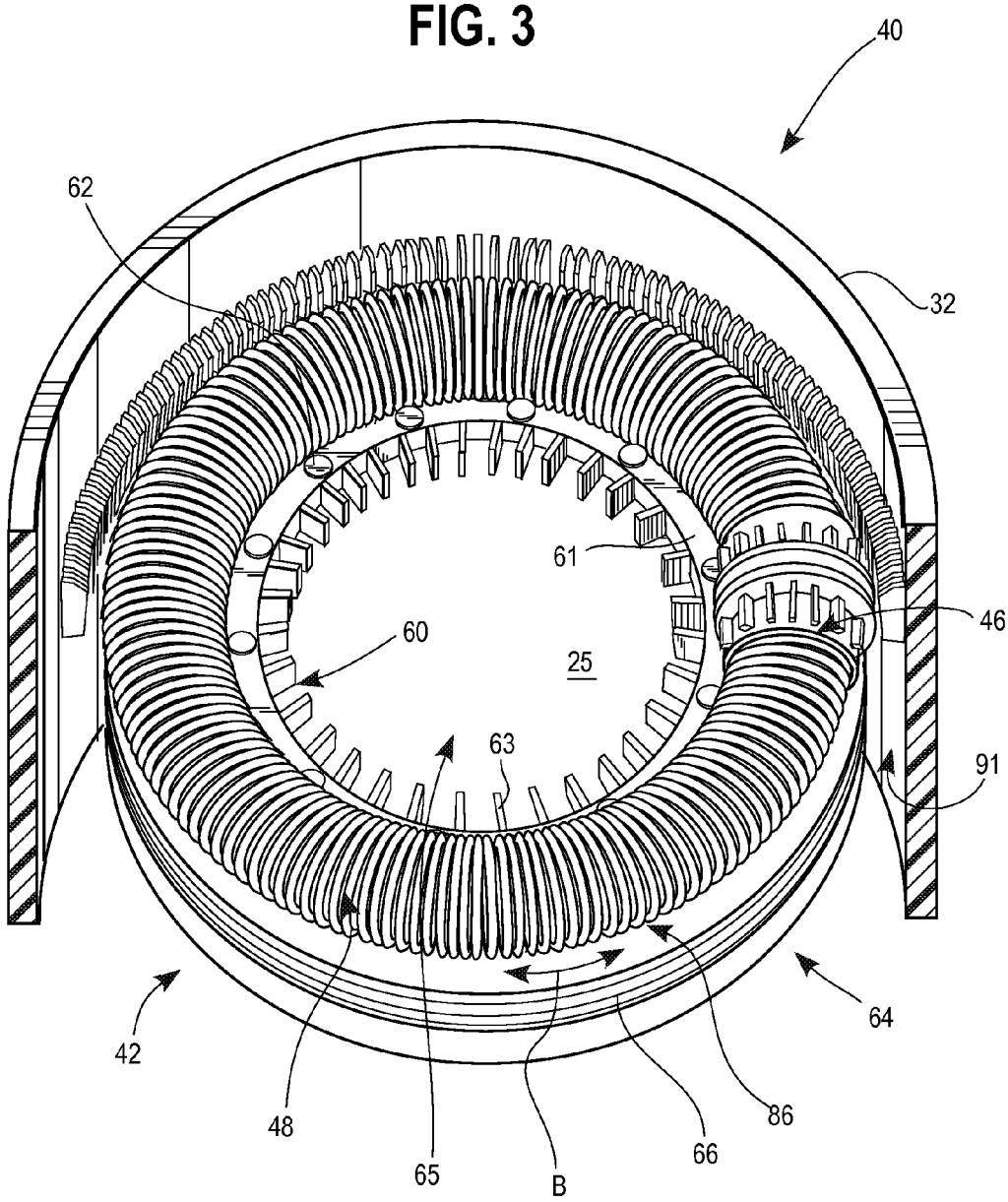
FIG. 3 is a perspective view of an exemplary drive system.
Figure 4:
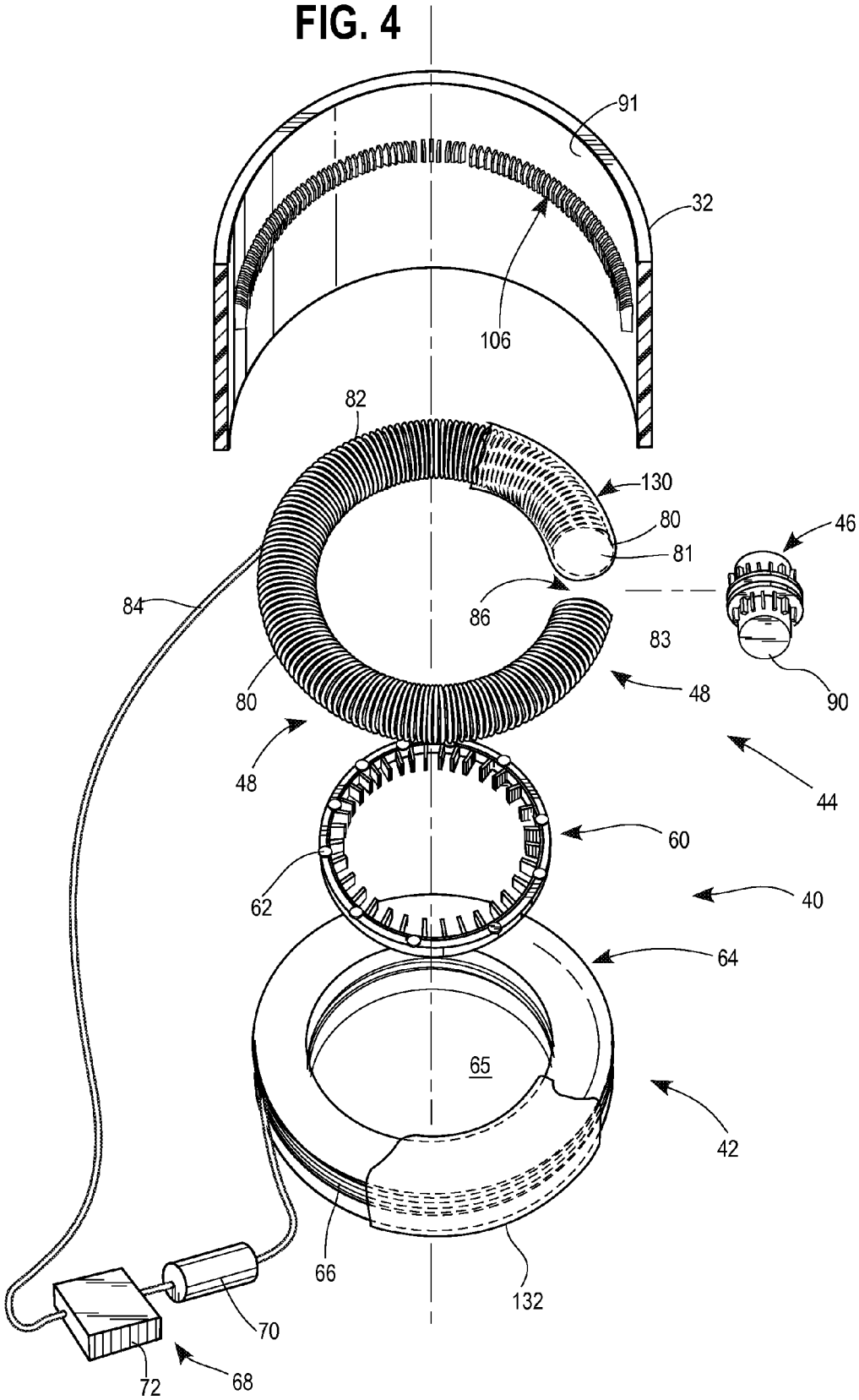
FIG. 4 is an exploded view of the exemplary drive system.
Figure 5:
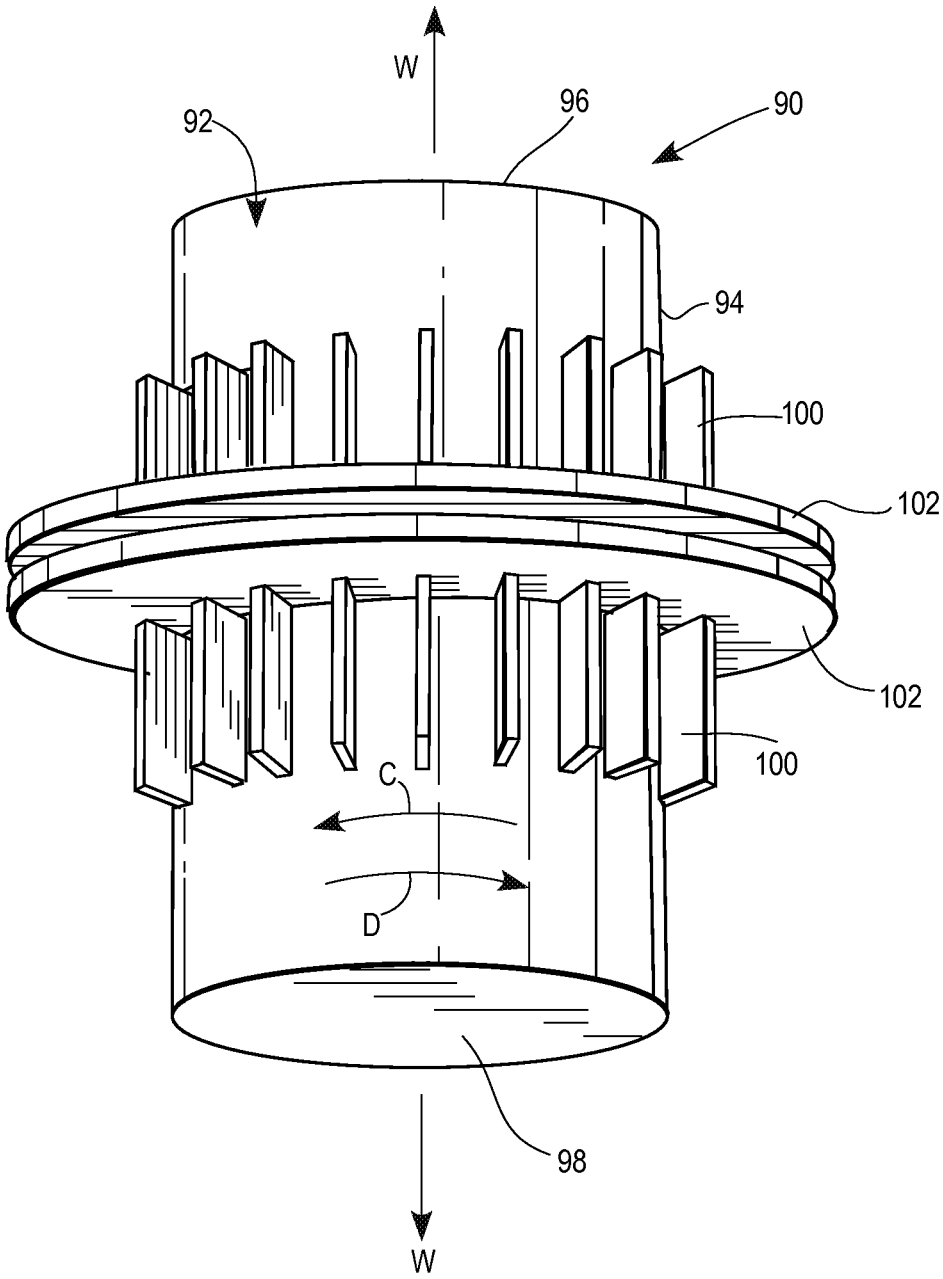
FIG. 5 is a perspective view of an exemplary worm gear of the exemplary drive system.

Turning to more of the specifics, one form of the exemplary drive system 40 is shown in more detail in FIGS. 3-5. In this exemplary approach, the electrical generator 42 includes a water driven turbine 60 positioned in the water flow path 25 so that pressurized water flowing between the inlet 28 and outlet 24 in the flow path 25 rotates or spins the turbine 60 about the housing axis X. In one form, the turbine 60 includes an annular ring body 61 with a plurality of fins or blades 63 extending from the body 61. As shown, the blades 63 extend radially inward from the ring body, but they may also extend in other directions as needed for a particular application. The turbine 60 includes one or more permanently polarized magnets 62 positioned, by one approach, at an outer periphery of the turbine ring body. As illustrated, the turbine 60 includes eleven magnets, but this is only exemplary and may include more or less as needed for a particular application. The turbine 60 is arranged and configured to spin within a stator assembly 64 having a coil of electrically conductive wire 66 wrapped therearound. As the turbine 60 spins within the stator assembly 64, the magnets 62 thereon interact with the conductive coil 66 to generate an electric current in the coil 66. By one approach, the stator assembly 64 may be a spool having a bore 65 extending therethrough and sized to receive the turbine 60 therein.

The electrical generator 42 may also include an electrical storage device 68 in electrical communication with the conductive coil 66 for storage of the electrical charge generated by the coil 66 and turbine 60 as generically shown in FIG. 4. By one approach, the electrical storage device 68 may include a capacitor 70 (or other storage device) and a voltage trigger 72 set to discharge the capacitor 70 upon it reaching a set voltage. By one approach, suitable voltage triggers 72 may include zener diodes and the like. Of course, other electrical storage devices, triggering mechanisms, electrical components, and circuits may also be used as needed for a particular application.

In use, as pressurized fluid flows through the flow path 25 of the sprinkler 10, the fluid drives or causes the turbine 60 to spin within the stator assembly 64 and coil 66 wrapped thereabout to generate an electric current in the coil 66. The current is then stored in the storage device 68 until it reaches a set voltage as determined by a voltage trigger 72. Once the maximum voltage is reached, the storage device 68 is discharged to allow the electrical current to energize the electromagnetic 48.

Once the storage device 68 has discharged, as long as fluid is still flowing through the flow path 25, the turbine 60 will continue to spin within the stator 64 and continue to generate an electric current, which will again recharge the storage device 68. This charge/discharge cycle will continue as long as pressurized fluid is flowing through the sprinkler flow path 25 during an irrigation cycle. When the voltage trigger 72 discharges the storage device 68, the electromagnet 48 in this exemplary embodiment is energized and magnetically polarized, which will be described in more detail below. Such magnetic polarization of the electromagnet 48 is operable to effect rotation of the turret 16 and the fluid outlet 24 thereof.

In order to effect rotation of the nozzle turret 14 and fluid outlet 24, the sprinkler 10 preferably employs the drive unit 44 that is electrically triggered by the discharge of the storage device 68. As discussed above, the drive unit 44 preferably includes the permanent magnet 46 and the electromagnet 48 that form the magnetic coupling or force 50 therebetween when the electromagnetic is polarized by the electrical discharge from the storage device 68. This magnetic coupling or force 50 is operable to rotate the nozzle turret.

By one approach, the electromagnet 48 is in the form of a C-shaped or penannular-shaped electromagnet having a central tube or cylindrical core 80 with a coil of conductive material or wire 82 extending about and/or wrapped around the core 80 in a manner effective to form an electromagnet when energized. As used herein, penannular generally means a shape in the form of an incomplete ring or an almost complete circle. The shape of the magnet 48 is only exemplary, and other sizes, shapes, and configurations are possible depending on the particular application.

The conductive wire 82 about the core 80 is in electrical communication 84 with the electrical generator 42 and, by one approach, the storage device 68 thereof as best shown in FIG. 4. By one approach, the core 80 is or includes ferromagnetic material, such as iron. As discussed in more detail below, because the electromagnet 48 is in electrical communication with the electrical generator 42, in use the generator 42 is configured to magnetically polarize the magnet 48 into opposite north and south magnetic poles, which is operable to drive the turret 16.

The C- or pennanular-shaped magnet 48 is a continuous body having end walls 81 and 83 that form or define a gap or other opening 86 at the mouth of the C-shape. The gap 86 is sized to receive the magnet 46 therein. To this end, both the magnet 48 and magnet 46 are positioned in the same operational plane. As best shown in FIG. 3, the C-shaped electromagnet 48 is positioned in the riser tube housing 32 so that it can rotate about the housing axis X. To facilitate such rotation, the magnet 48, in one approach, may be seated in a guide track or other mounting 86, such as a concave-shaped annular track permitting it to freely turn in a direction about the axis X indicated by the directional arrow B. As shown, the guide track 86 is mounted to an upper surface of the stator assembly 64, but the magnet 48 and any mounting 86 therefor may be provided in other locations in the sprinkler 10 as needed for a particular application. Combining the guide track 86 on the stator assembly 64 can be advantageous because it forms a compact configuration.

In one form, the permanent magnet 48 may be provided on, within, or as a worm gear assembly 90 received within the gap 86 of the electromagnet 48. The worm gear/permanent magnet 48, 90 is configured to interact with both a stationary inside wall 91 of the riser tube 32 and the electromagnet 48 to effect movement of the turret 16, which will be described in more detail below after an exemplary description of the worm gear 90 is provided.

Figure 6:
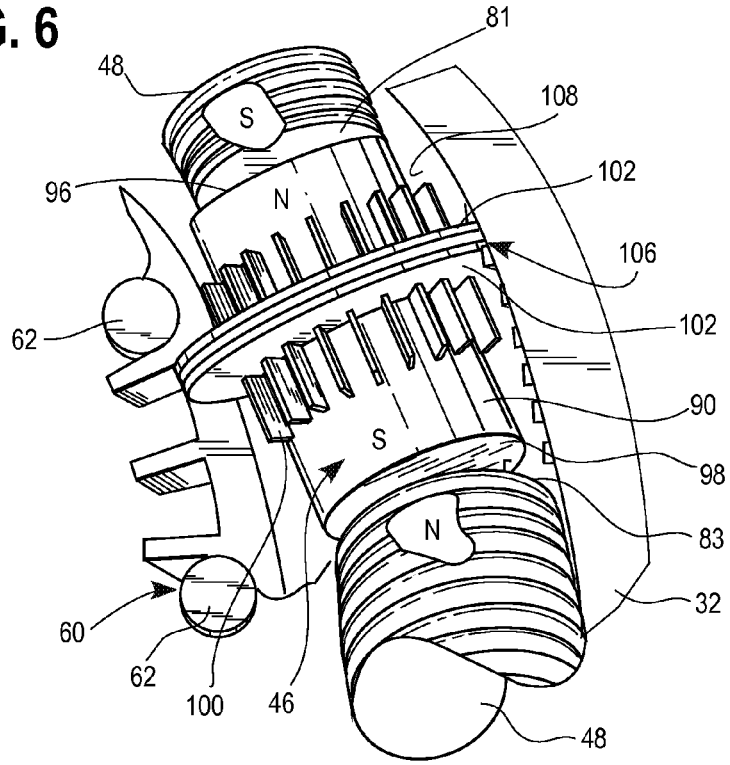
FIG. 6 is a partial perspective view of components of the exemplary drive system.
Figure 7:
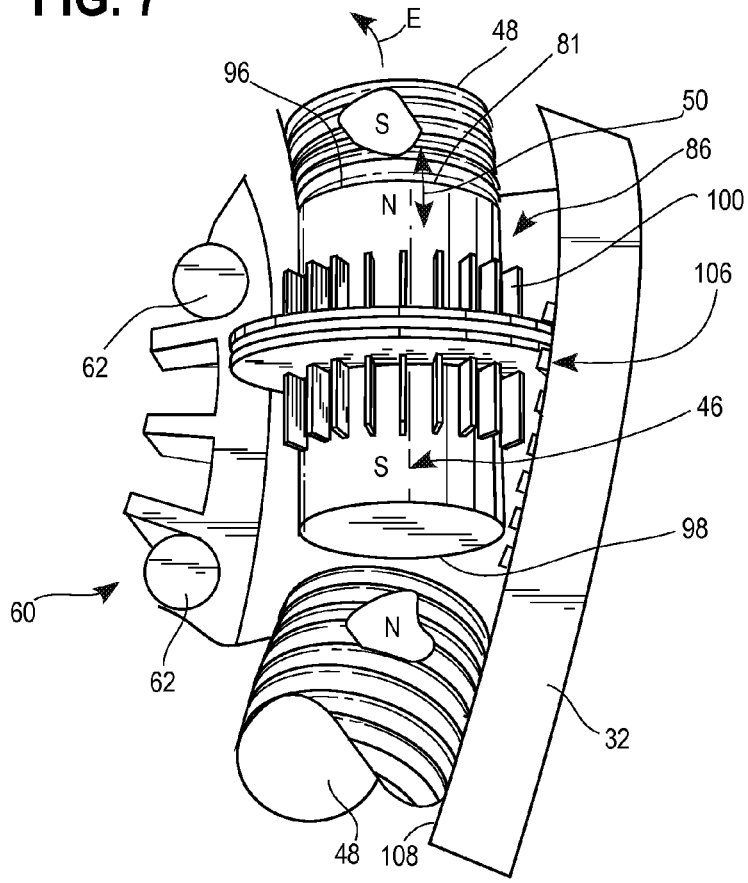
FIG. 7 is a partial perspective view of components of the exemplary drive system.

Turning to FIGS. 5 to 7 for a moment, an exemplary form of the worm gear 90 is illustrated in more detail. In this approach, the worm gear 90 has a cylindrical body 92 with an annular side wall 94 extending between opposite, generally flat end walls 96 and 68. The worm gear 90 has a longitudinal axis W extending through the end walls 96 and 98 and, when mounted in the drive unit 44, extends generally transverse to the sprinkler axis X. The annular side wall 94 includes one or more longitudinal paddles 100 positioned thereon so that an upwardly directly fluid flow may engage the paddles 100 to rotate the worm gear 90 about the longitudinal axis W as shown by directional arrows C or D depending on the direction of fluid flow engaging the paddles 100. To this end, a fluid flow director may be provided to guide the flow of fluid to engage either one side or other of the paddles 100 to control rotation of the worm gear in one direction or another about the axis W. As shown, the paddles 100 extend generally parallel to the axis W, but may also be inclined thereto as needed to effect rotation. The permanent magnet 46 may be mounted to or coupled with the body 92, may form a portion or the entire body 92, or may otherwise be coupled to the worm gear 90.

To interact with the inside surface of the stationary riser tube 32, the worm gear 90 may also include one or more circumferential or annular ribs 102 extending about the side wall 94 generally transverse to the axis W. The ribs 102 can be or include threading, have a pitch, or be suitably configured so that they can mate in a geared relationship with a gear track 106 as described further below. As shown in FIG. 5, two ribs are provided, but the gear 90 may include more or less ribs as needed. By one approach, the ribs 102 are configured to interact with the riser tube 32 and, in particular, mate in a geared relationship with a geared track 106 formed on an inside surface 108 of an annular wall 91 forming the riser tube 32 as best shown in FIGS. 6 and 7. As the worm gear 90 rotates due to the upward flow of fluid engaging the paddles 100, the mating of the ribs 102 and the geared track 106 operates to enable the worm gear 90 to crawl or traverse circumferentially about the X axis and about the inside surface 108 of the riser wall 91. During use, as the worm gear 90 is positioned within the gap 86 of the electromagnetic 48, the worm gear 90 will crawl along the geared track 106 until one of the end walls 96 or 98 (depending on the direction of travel) contacts one of the end walls 81 or 83 of the electromagnet forming the gap 86 as illustrated in FIG. 7. At this point, the worm gear 90 stops turning. As illustrated, FIG. 6 shows the worm gear 90 in an intermediate position in the gap 86 between end walls 81 and 83 of the electromagnet 48. In this position, the worm gear 90 is free to spin about the W axis due to the upward flow of fluid in the flow path 25 when the sprinkler is in use. FIG. 7 shows the worm gear 90 after it has crawled along the track 106 a circumferential distance to engage the end wall 81 of the electromagnet 48. In the position of FIG. 7, the worm gear is hindered from spinning.

At the same time as the worm gear 90 is turning and crawling about the riser tube wall 91 due to the upwardly directed flow in the flow path 25 as described above, the electrical storage device 68 is being charged by the electrical generator 42 as the turbine 60 is spinning in the stator assembly 64 as explained above. Once the storage device 68 reaches the voltage threshold, the voltage trigger 72 or other controlling device causes the storage device 68 to discharge its electrical charge to the electromagnet 48 causing the electromagnet to be polarized into a magnet having opposite magnetic poles.

As shown in FIG. 6, once energized, the electrically polarized electromagnet 48 in one approach has a north pole adjacent the end wall 81 and a south pole adjacent end wall 83. This arrangement may also be reversed. In one approach, the electromagnetic 48 and the permanent magnet 48 (located in or on the worm gear 90) are arranged to have the same magnetic poles facing or adjacent each other in order to form the magnetic repulsion force 50. Thus, as shown FIGS. 6 and 7, the worm gear/magnet 46, 90 has a north pole adjacent the end wall 96 and a south pole adjacent the end wall 98. Again, this could be reversed as needed. So configured, a magnetic repulsion force 50 between the same poles of the magnet 46 and 48 results when the worm gear 90 has traversed the wall 91 a sufficient circumferential distance so that the north pole of its end wall 96 contacts or is sufficiently adjacent the north pole of the end wall 81 of the magnet 48 as shown in FIG. 7.

As the same poles of the magnets 46 and 48 are arranged in such configuration, the permanent magnet 46 (in the worm gear 90) is configured to magnetically push or drive (i.e., Arrow E in FIG. 7) the electromagnet 48 away from the end wall 96 of the magnetic worm gear 46, 90 along the track 86 a short distance due to the magnetic repulsion force. The distance of the push may vary depending on the strength of the magnetic force. Thus, the electromagnet 48 rotates circumferentially about the housing axis X due to this magnetic push from the worm gear 90. Of course, the polarities of the magnets can be reversed as the description above is illustrated of only one example. (Alternatively, the magnetic force 50 may be a magnetic attraction force to push or pull the magnets.) In this exemplary approach, the magnetic repulsion force 50 causes the magnet 48 to move or rotate because the magnet 48 is freely sitting on the track 86 or otherwise arranged to rotate, slide, or shift about the axis X, and at the same time, the worm gear/magnet 46, 90 is engaged or coupled in a geared relationship with the gear track 106, which restrains the gear 90 from movement at this point in the operation. Thus, the magnetic repulsion force 50 causes the magnet 48 to push away from the end wall 81 of the worm gear 90, which is generally wedged against or in the track 106.

Returning to FIG. 2 for a moment, the nozzle turret 16 and the outlet 24 thereof is preferably linked or coupled 52 to the electromagnet 48. The linkage may be through a mechanical connection, gears, levers, or the like, may be an electrical connection, or may be a magnetic connection. Thus, as the electromagnet 48 is pushed by the magnetic force 50 between it and the permanent magnet 46 as described above, the turret 16 and outlet 24 are rotated a similar or corresponding distance about the axis X.

After the storage device 68 discharges and the permanent magnet 46 pushes (or pulls) the electromagnet 48 a circumferential distance, the electromagnet 48 is then de-energized. At this point, the worm gear 90 (because the electromagnet 48 is now moved away from it) is free to spin again due to the upward flow of fluid and crawl along the geared track 106 to again move into contact with the end wall 81 of the electromagnet 48; thus, repeating the cycle discussed above. The storage device 68 is then recharged again due to the continued spinning of the turbine 60 within the stator 64, and the process is repeated. Thus, the turret 16 and fluid outlet 24 thereof are incrementally or intermittently rotated as this charge/discharge process is repeated numerous times via an electric pulse or pulses during an irrigation cycle as long as the irrigation fluid is on and flowing through the flow path 25.

Figure 8:
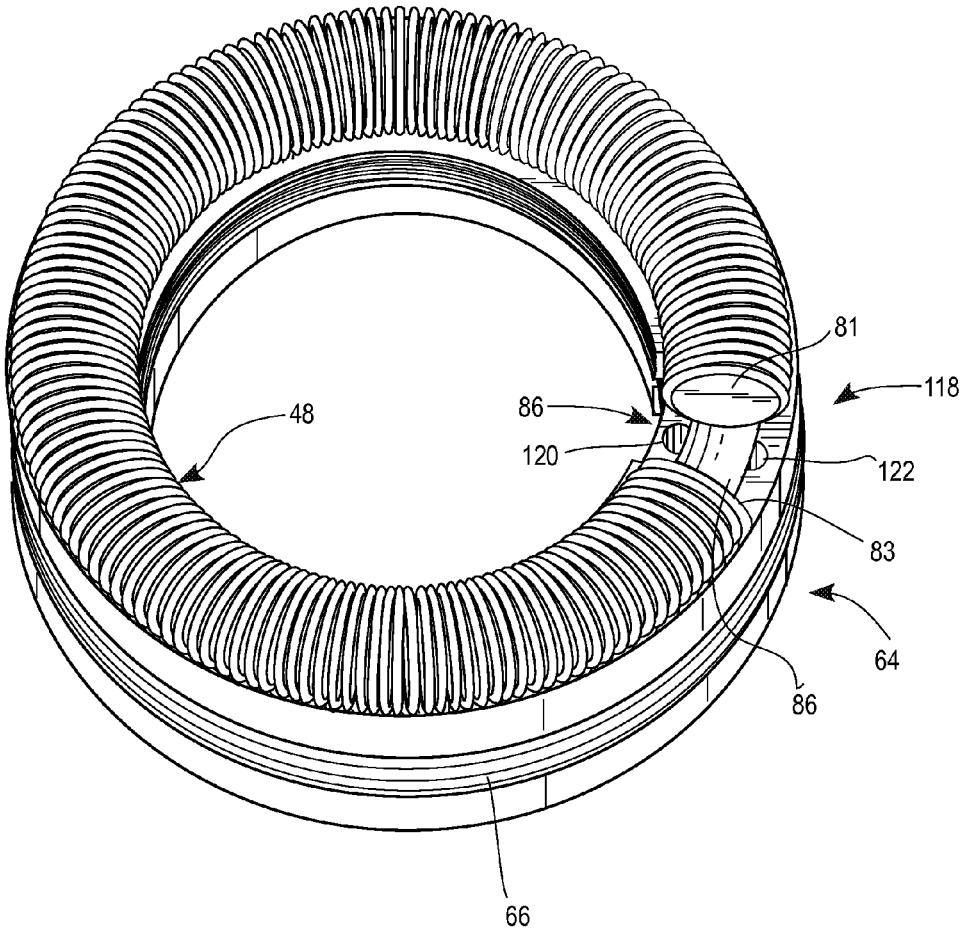
FIG. 8 is a partial perspective view of components of the exemplary drive system.

Turning to FIG. 8, the electromagnet 48 and stator assembly 64 are illustrated with the worm gear removed to show a generic example of a flow director 118. For example, to reverse rotation of the nozzle turret 16, the drive mechanism 40, by one approach, may include a trip valve or other directional valve 119 that controls an exit port or directional nozzle 120 or 122 that the irrigation fluid uses to enter the drive system 40 to turn the worm gear 90. Depending on which port or nozzle 120 or 122 is used or open, the irrigation fluid will be directed against one side or the other of the worm gear 90 so that it either rotates in a clockwise or counterclockwise direction about the axis W as the irrigation fluid engages either one side or the other of the worm gear paddles 100. Depending on the direction of rotation of the worm gear 90, it will either crawl in one circumferential direction or the other about the gear track 106, which will effect reversing rotation of the nozzle turret 16 because the operations described above occur in a reverse direction.

The drive unit 44 may also employ seals or membranes about various components to provide a sealing thereabout. Turning back to FIG. 4, to make the electromagnet 48 waterproof and/or watertight, it may be covered or sealed with a seal 130 or other water tight covering, coating, membrane, seal, and the like. By one approach, the seal 130 may be a thin water tight membrane of a plastic material or other conformable film that surrounds the magnet 48. The seal 130 may also be a coating, varnish, or other application about the magnet 48. The electrical generator 42 may also employ a separate seal 132 wrapped about to provide fluid sealing. For example, the stator 64 and coil 66 may have the seal 132 wrapped therearound. The seal 132 may also be a thin water tight membrane of a plastic material, other conformable film, coating, varnish, or application that surrounds both the stator body 64 and coil 66 to hinder and, preferably, prevent fluid from contacting the coil and other components thereof. For clarity in FIG. 4, the seals 130 and 132 are shown only partially about the magnet 48 and generator 42, but it will be appreciated that the seals 130 and 132 may extend about each component entirely as needed to provide protection from fluid.

It will be understood that various changes in the details, materials, and arrangements of parts and components which have been herein described and illustrated in order to explain the nature of the sprinkler and drive mechanism thereof may be made by those skilled in the art within the principle and scope of the sprinkler as expressed in the appended claims. Furthermore, while various features have been described with regard to a particular embodiment or a particular approach, it will be appreciated that features described for one embodiment also may be incorporated with the other approaches to irrigation sprinklers as well.

What is claimed is:

1. A magnetically driven irrigation sprinkler comprising:

a sprinkler body having a longitudinal axis thereof and including a fluid inlet, a fluid outlet rotatable about the longitudinal axis relative to the fluid inlet, and a fluid flow path extending between the fluid inlet and the fluid outlet;

an electrical generator mounted to the sprinkler body, the electrical generator arranged and configured to generate an electrical current from fluid flowing through the fluid flow path;

a drive mechanism for rotating the fluid outlet relative to the fluid inlet, the drive mechanism including a permanently polarized magnet and an electromagnet coupled to the fluid outlet and in electrical communication with the electrical generator to be magnetically polarized thereby; and a magnetic coupling between the permanently polarized magnet and the electrically polarized electromagnet so that a magnetic force therebetween moves the electromagnet relative to the permanently polarized magnet to effect a rotation of the fluid outlet relative to the fluid inlet; and wherein the permanent magnet is provided with a worm gear arranged and configured to rotate transverse to the housing axis.

2. The sprinkler of claim 1, wherein the electrical generator includes a fluid driven turbine positioned in the fluid flow path and having at least one permanently polarized magnet thereon.

3. The sprinkler of claim 2, wherein the fluid driven turbine rotates within a stator assembly having electrically conductive material mounted thereto and positioned to surround the fluid driven turbine so that rotation of the at least one permanently polarized magnet on the fluid driven turbine relative to the electrically conductive material generates the electrical current.

4. The sprinkler of claim 1, wherein the electrical generator includes an electrical storage device for storing the electrical current.

5. The sprinkler of claim 4, wherein the electrical storage device includes a capacitor and a voltage trigger set to discharge the capacitor upon the capacitor reaching a trigger voltage, the discharge of the capacitor being effective to energize the electromagnet.

6. The sprinkler of claim 1, wherein the magnetic coupling includes a magnetic repulsion force between oppositely polarized poles of the permanently polarized magnet and the electrically polarized electromagnet to magnetically move the electromagnet relative to the permanently polarized magnet.

7. The sprinkler of claim 1, wherein the worm gear has a cylindrical body defined by an annular side wall extending between opposite end walls and includes a worm gear axis extending through both end walls and extending transverse to the longitudinal axis.

8. The sprinkler of claim 7, wherein the worm gear includes paddles arranged and configured so that fluid flowing through the flow path engages the paddles to rotate the worm gear about the worm gear axis.

9. The sprinkler of claim 8, wherein the sprinkler body includes a housing defined by an annular wall that includes a geared track extending circumferentially about an inner surface thereof.

10. The sprinkler of claim 9, wherein the worm gear includes a mating gear defined on the cylindrical body that is arranged and configured to mate in a geared relationship with the geared track on the inner surface of the annular housing wall such that rotation of the worm gear about the worm gear axis and the geared relationship effects circumferential movement of the worm gear relative to the longitudinal axis.

11. The sprinkler of claim 1, wherein the electromagnet is formed from a penannular shaped core wrapped with a coil of electrically conductive material.

12. The sprinkler of claim 11, wherein the core includes a ferromagnetic material.

13. The sprinkler of claim 11, wherein the penannular shaped core is defined by a cylindrical body having opposite ends thereof that define a gap extending between the opposite ends.

14. A magnetically driven irrigation sprinkler comprising:

a sprinkler body having a longitudinal axis thereof and including a fluid inlet, a fluid outlet rotatable about the longitudinal axis relative to the fluid inlet, and a fluid flow path extending between the fluid inlet and the fluid outlet;

an electrical generator mounted to the sprinkler body, the electrical generator arranged and configured to generate an electrical current from fluid flowing through the fluid flow path;

a drive mechanism for rotating the fluid outlet relative to the fluid inlet, the drive mechanism including a permanently polarized magnet and an electromagnet coupled to the fluid outlet and in electrical communication with the electrical generator to be magnetically polarized thereby; and a magnetic coupling between the permanently polarized magnet and the electrically polarized electromagnet so that a magnetic force therebetween moves the electromagnet relative to the permanently polarized magnet to effect a rotation of the fluid outlet relative to the fluid inlet;

wherein the electromagnet is formed from a penannular shaped core wrapped with a coil of electrically conductive material;

wherein the penannular shaped core is defined by a cylindrical body having opposite ends thereof that define a gap extending between the opposite ends; and wherein the permanent magnet is positioned within the gap of the electromagnet.

15. The sprinkler of claim 14, wherein the permanent magnet is provided with a worm gear arranged and configured in the sprinkler housing to rotate transverse to the housing axis within the gap of the electromagnet.

16. The sprinkler of claim 15, wherein the worm gear has a cylindrical body defined by an annular side wall extending between opposite end walls and includes a worm gear axis extending through both end walls and transverse to the housing axis, and wherein the worm gear includes paddles arranged and configured so that fluid flowing through the flow path rotates the worm gear about the worm gear axis within the gap of the electromagnet.

17. The sprinkler of claim 16, wherein the sprinkler body includes a housing defined by an annular wall that has a geared track extending circumferentially about an inner surface thereof, and wherein the worm gear includes a mating gear on the cylindrical body thereof that is arranged and configured to mate in a geared relationship with the geared track on the inner surface of the annular housing wall such that rotation of the worm gear and the geared relationship effects circumferential movement of the worm gear relative to the longitudinal axis to move the worm gear into an abutting engagement with one of the opposite ends of the electromagnet cylindrical body.

18. The sprinkler of claim 17, wherein the magnetic coupling includes a magnetic repulsion force between oppositely polarized poles of the permanently polarized magnet and the electrically polarized electromagnet where the magnetic repulsion force moves the electromagnet away from the abutting engagement from the worm gear.

19. The sprinkler of claim 1, wherein the electrical generator and drive mechanism are disposed in a pop-up riser assembly of a rotary irrigation sprinkler.

* * * * *